United States Patent [19]

Todorovic

[11] Patent Number: 4,838,819

[45] Date of Patent: Jun. 13, 1989

[54] MARINE PROPULSION UNIT

[76] Inventor: Dobrivoje Todorovic, 28 Horning Drive, Kitchener, Ontario, Canada, N2K 1H6

[21] Appl. No.: 187,460

[22] Filed: Apr. 28, 1988

[30] Foreign Application Priority Data

May 22, 1987 [CA] Canada ..... 537806

[51] Int. Cl.[4] ..... B63H 11/103

[52] U.S. Cl. ..... 440/47; 440/48

[58] Field of Search ..... 440/38, 47, 48, 66; 60/221, 222; 416/179, 181, 189; 415/77

[56] References Cited

U.S. PATENT DOCUMENTS

| | | | |
|---|---|---|---|
| 3,011,561 | 12/1961 | Wagener | 440/48 |
| 3,082,732 | 3/1963 | Stallman | 440/48 |
| 3,087,302 | 4/1963 | Brown | 440/47 |
| 3,678,689 | 7/1972 | Ishiwata | 440/47 |
| 3,805,731 | 4/1974 | Furst et al. | 440/47 |
| 4,631,032 | 12/1986 | Nishida | 440/47 |
| 4,718,870 | 1/1988 | Watts | 440/47 |

*Primary Examiner*—Sherman D. Basinger
*Assistant Examiner*—Stephen P. Avila
*Attorney, Agent, or Firm*—R. Craig Armstrong

[57] ABSTRACT

This marine propulsion unit has a main shaft for connection to a drive shaft, and a helical screw along the main shaft. A duct surrounds the main shaft and screw thereby creating a ducted area. The ducted area has a water inlet near its proximal end and a water outlet near its distal end, the ducted area being tapered from inlet to outlet, whereby water is accelerated through the ducted area to provide propulsion. A number of secondary inlet ports are disposed along and pass through the duct into the ducted area, for drawing in water to minimize cavitation along the ducted area. In an alternative embodiment, there is also a second duct coaxial with and surrounding the first duct, thereby creating a second ducted area. The second ducted area has a water inlet near its proximal end and a water outlet near its distal end, the ducted area being tapered from inlet to outlet. A second helical screw is provided along the first duct in the second ducted area, and the first duct is connected to the main shaft so that the first duct rotates with the main shaft. Additional secondary inlet ports are provided.

3 Claims, 6 Drawing Sheets

MARINE PROPULSION UNIT

BACKGROUND OF THE INVENTION

This invention relates to marine propulsion, and particularly to a novel helical screw ducted turbine.

Marine propulsion is usually achieved by accelerating water and propelling it away from the watercraft. Rapid acceleration of the water produces cavitation, which renders the efficiency of conventional propellers quite low.

It is an object of the present invention to provide a marine propulsion unit which avoids or minimizes the problem of cavitation by combining gradual acceleration with the use of ducting and secondary water inlets to cavitation-prone areas.

SUMMARY OF THE INVENTION

Thus in accordance with the present invention there is provided a marine propulsion unit having a main shaft for connection to a drive shaft, and a helical screw along the main shaft. A duct surrounds the main shaft and screw thereby creating a ducted area. The ducted area has a water inlet near its proximal end and a water outlet near its distal end, the ducted area being tapered from inlet to outlet, whereby water is accelerated through the ducted area to provide propulsion. A number of secondary inlet ports are disposed along and pass through the duct into the ducted area, for drawing in water to minimize cavitation along the ducted area.

In an alternative embodiment, there is also a second duct coaxial with the surrounding the first duct, thereby creating a second ducted area. The second ducted area has a water inlet near its proximal end and a water outlet near its distal end, the ducted area being tapered from inlet to outlet. A second helical screw is provided along the first duct in the second ducted area, and the first duct is connected to the main shaft so that the first duct rotates with the main shaft. Additional secondary inlet ports are provided.

Further features of the invention will be described or will become apparent in the course of the following detailed description.

The invention may be applied in many ways. For example, the unit may be attached to the fairing of a standard outboard or inboard-outboard motor, with the main shaft being connected to the propeller drive shaft. In this way, the unit can be used as a direct replacement for an ordinary propeller.

Alternatively, the unit can be incorporated into new structures, by connecting the main shaft to an engine via any suitable transmission and drive shaft arrangement. For example, one application which has been envisioned is in a circular watercraft, with the propulsion unit pivotally mounted on the central axis.

Another application, particularly suitable for large ships, is as an auxiliary drive unit for rudder movement, steering, or lateral movement.

BRIEF DESCRIPTION OF THE DRAWINGS

In order that the invention may be more clearly understood, the preferred embodiment thereof will be described in detail by way of example, with reference to the accompanying drawings, in which.

DETAILED DESCRIPTION OF THE PREFERRED EMBODIMENT

Figure 1:
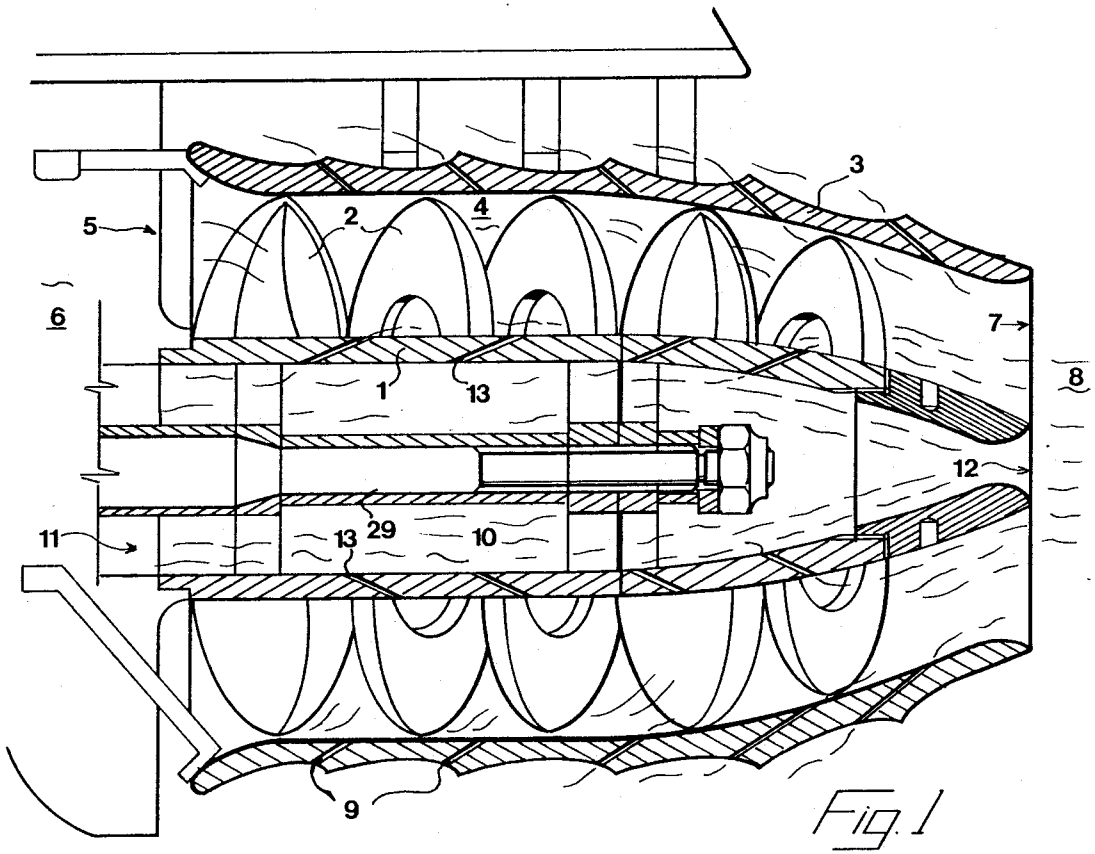
FIG. 1 is a side view of a simple version of the invention.

Referring to FIG. 1, a first embodiment of the marine propulsion unit as contemplated by the present invention has a main shaft 1 which is connected to the drive shaft (not shown) of a watercraft (not shown) via the central shaft 29 connected to the main shaft 1. A helical screw 2 is coaxial with and surrounds the main shaft 1, and rotates with the main shaft 1 when the latter is rotated by the drive shaft and central shaft 29.

A duct 3 is coaxial with and surrounds both the helical screw 2 and main shaft 1. The duct 3 is not connected to the main shaft 1 and does not rotate with the main shaft 1 and helical screw 2 in response to the rotation of the drive shaft. The duct 3 has a water inlet 5 towards the proximal end 6 of the propulsion unit, and a water outlet 7 at the distal end 8 of the propulsion unit. The duct 3 is tapered from the inlet 5 to the outlet 7.

A ducted area 4 is defined between the duct 3 and the main shaft 1. As the helical screw 2 is rotated, water is drawn in through the inlet 5, is forced through the ducted area 4 and out of the outlet 7. The water is accelerated as it moves through the tapered ducted area 4, which could tend to cause cavitation in the ducted area 4. Secondary inlet ports 9 are provided at spaced intervals along the duct 3 to allow water to flow into the ducted area 4 from outside the propulsion unit so as to reduce any tendency for cavitation.

The main shaft 1 may include a cylindrical passage 10 through which water flows from a main shaft inlet 11 at the proximal end 6 of the propulsion unit to a main shaft outlet 12 at the distal end 8 of the propulsion unit. The main shaft 1 is tapered from the main shaft inlet 11 to the main shaft outlet 12. Main shaft secondary outlet ports 13 are provided in the main shaft 1 to allow water to flow from the cylindrical passage 10 into the ducted area 4. Several blades 14 of the helical screw 2 have cavities 15 to allow the water to pass easily from the cylindrical passage 10 to the ducted area 4. Water is drawn through the main shaft secondary outlet ports 13 into the ducted area 4, thereby assisting in minimizing cavitation and in thus potentially increasing the efficiency of the propulsion unit.

Figure 2:
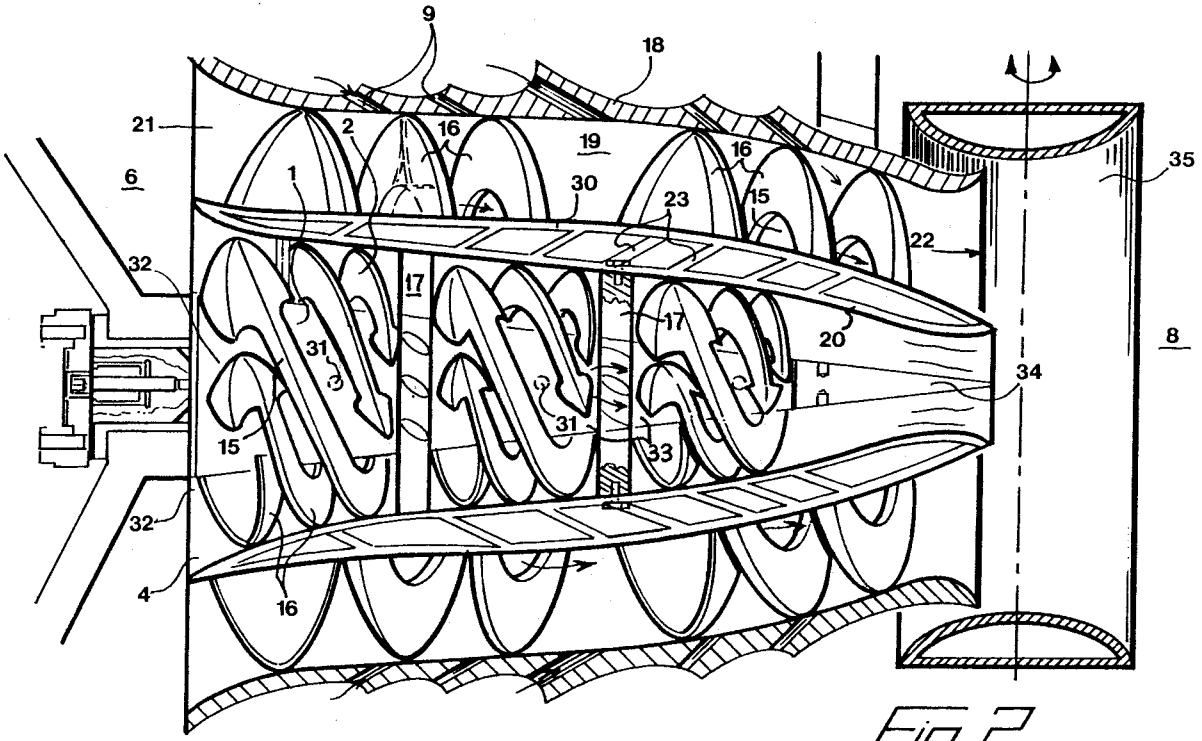
FIG. 2 is a side view of a more complex version of the invention.

An alternative embodiment of the invention is shown in FIG. 2. In the alternative embodiment a second duct 18 and helical screw 16 are provided in the propulsion unit. The second duct 18 is coaxial with the main shaft 1 and surrounds both the main shaft 1 and the first helical screw 2. The second helical screw 16 is mounted on the first duct 20 which is connected to the main shaft 1 and central shaft 29 by means of connecting struts 17. When the main shaft 1 rotates in response to the rotation of the drive shaft, the first helical screw 2, the first duct 20 and the second helical screw 16 all rotate in unison with the main shaft 1.

The second duct 18 is not connected to the main shaft 1 and as a consequence does not rotate with the main shaft 1 and other rotating components. A second ducted area 19 is defined between the first duct 29 and the second duct 18.

A second duct inlet 21 is provided towards the proximal end 6 of the propulsion unit, and a second duct outlet 22 is provided at the distal end 8 of the propulsion unit. The second duct 18 is tapered from the second duct inlet 21 to the second duct outlet 22. When the main shaft 1 rotates, water is drawn into the cylindrical passage 10, the first ducted area 4 and the second ducted area 19. As the water is accelerated through the first ducted area 4 and second ducted area 19, water moves through the various inlet ports to reduce the tendency towards cavitation. Water flows into the second ducted area 19 from the first ducted area 4 through first duct inlet ports 23 in the first duct 20. As is the case with the first helical screw 2, several blades 14 of the second helical screw 16 have cavities 15 to allow water to pass readily through the first duct outlet ports 23 and into the second ducted area 19. Secondary inlet ports 9 are provided in the second duct 18 to allow water to pass into the second ducted area 19 from outside the propulsion unit.

Figure 6:
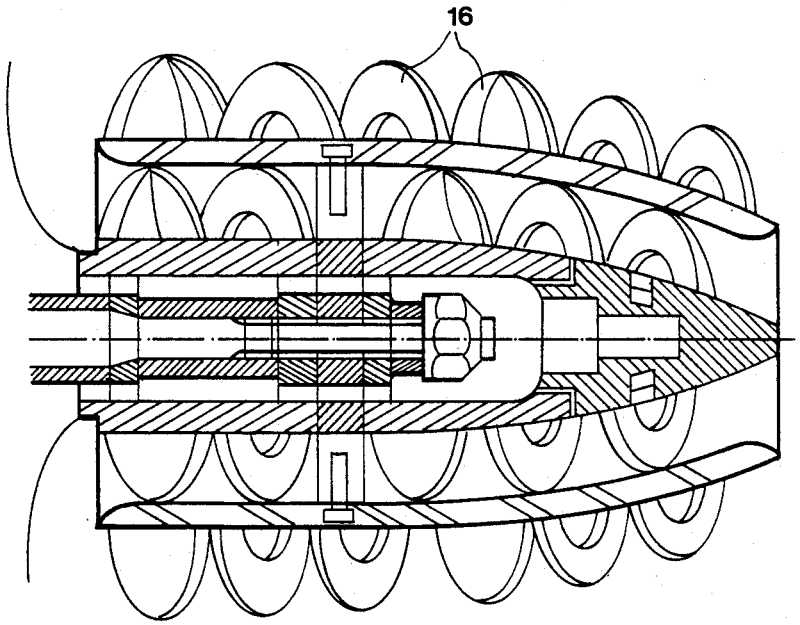
FIG. 6 is a side sectional view of another alternative embodiment.

FIG. 6 shows an alternative embodiment, in which a second helical screw 16 is provided, but in which no second or outer duct 18 is provided. The main shaft is sealed off, i.e. there is no water flow through it.

It will be obvious to one skilled in the art that any number of ducts and helical screws could theoretically be provided around the main shaft to increase the output of the propulsion unit.

Figure 3:
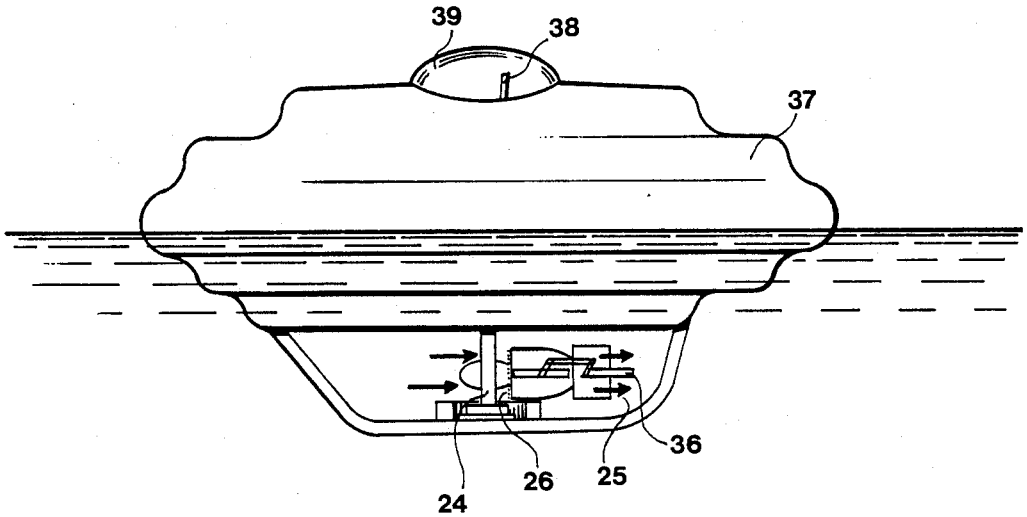
FIG. 3 is a sketch of a circular watercraft embodying the invention.
Figure 4:
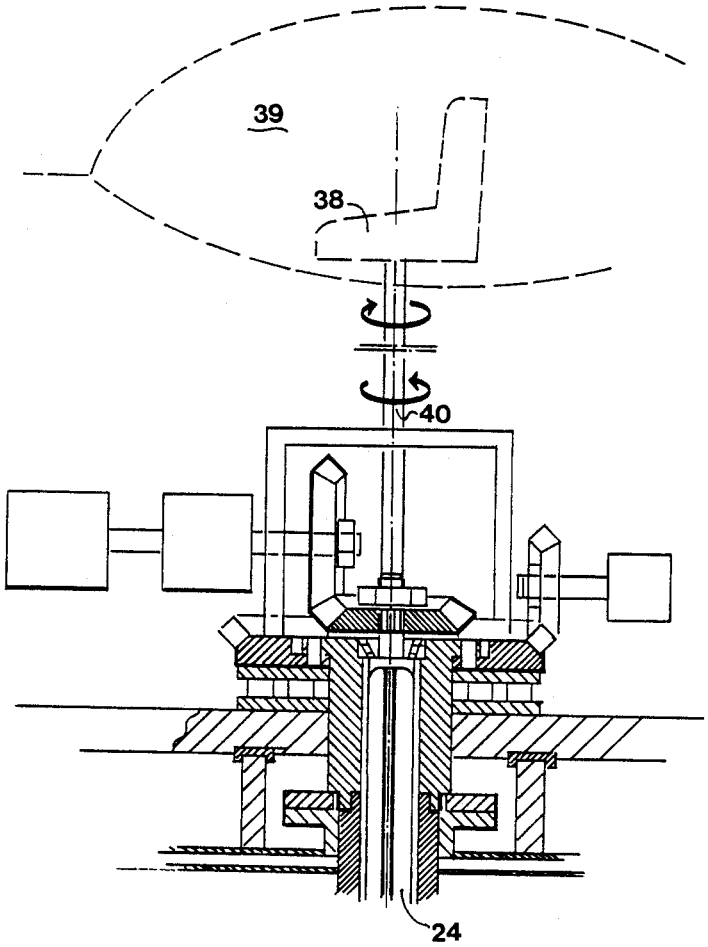
FIG. 4 is a more detailed sketch of the circular watercraft.

As is shown in FIGS. 3 and 4, the marine propulsion unit may be attached to a circular craft by means of a vertical shaft 24. The positioning of the vertical shaft 24 allows the propulsion unit to be swiveled horizontally. This enables the jet of water which is propelled out of the outlet 25 to be propelled in any horizontal direction. At least one net 26 maybe positioned at the proximal end 6 of the propulsion unit, to prevent seaweed and other marine debris from entering the propulsion unit.

Figure 5:
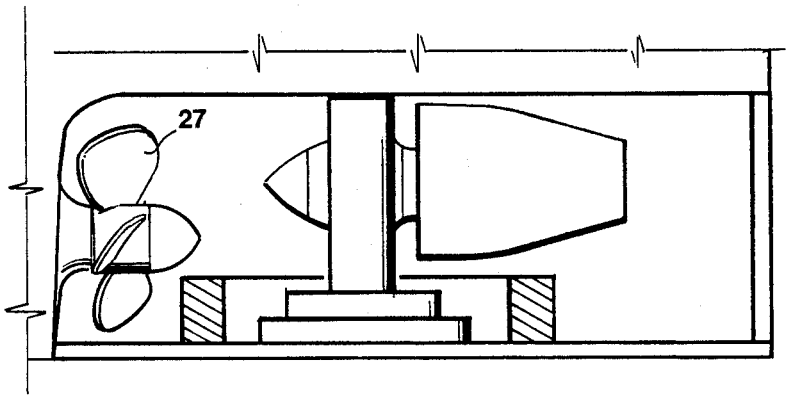
FIG. 5 is an illustration of the invention used in connection with the rudder of a large ship.

In FIG. 5 another application of the invention is shown. The marine propulsion unit is positioned aft of a regular propeller 27, so as to drive or act as a rudder.

The above description relates to the preferred embodiment by way of example only. Many variations on the invention will be obvious to those knowledgeable in the field, and such obvious variations are within the scope of the invention, whether or not expressly described.

What is claimed as the invention is:

1. A marine propulsion unit comprising:

a main shaft having a proximal end for connection to a drive shaft;

a helical screw along said main shaft;

a duct surrounding said main shaft and screw thereby creating a ducted area, said ducted area having a water inlet near said proximal end and a water outlet near said distal end, said ducted area being tapered from inlet to outlet; whereby water is accelerated through said ducted area to provide propulsion when said water is expelled out said outlet;

further comprising a plurality of secondary inlet ports disposed along and passing through said duct into said ducted area, for drawing in water to minimize cavitation along said ducted area;

in which said main shaft is hollow, having a water inlet at its proximal end and a water outlet at its distal end, further comprising a plurality of secondary inlet ports disposed along and passing through said main shaft into said ducted area for drawing in water to minimize cavitation along said ducted area.

2. A propulsion unit as recited in claim 1, further comprising a second duct coaxial with and surrounding said first duct thereby creating a second ducted area, said second ducted area having a water inlet near said proximal end and a water outlet near said distal end, said ducted area being tapered from inlet to outlet;

a second helical screw along said first duct in said second ducted area; and means connecting said first duct to said main shaft so that said first duct rotates with said main shaft;

further comprising a plurality of secondary inlet ports disposed along the passing through said second duct into said second ducted area, and a plurality of secondary inlet ports disposed along and passing through said first duct into said second ducted area, for drawing in water to minimize cavitation along said second ducted area.

3. A marine propulsion unit comprising:

a main shaft having a proximal end for connection to a drive shaft;

a helical screw along said main shaft;

a duct surrounding said main shaft and screw thereby creating a ducted area, said ducted area having a water inlet near said proximal end and a water outlet near said distal end, said ducted area being tapered from inlet to outlet; whereby water is accelerated through said ducted area to provide propulsion when said water is expelled out said outlet;

further comprising a second duct coaxial with and surrounding said first duct thereby creating a second ducted area, said second ducted area having a water inlet near said proximal end and a water outlet near said distal end, said ducted area being tapered from inlet to outlet;

a second helical screw along said first duct in said second ducted area; and means connecting said first duct to said main shaft so that said first duct rotates with said main shaft;

further comprising a plurality of secondary inlet ports disposed along and passing through said second duct into said second ducted area, and a plurality of secondary inlet ports disposed along and passing through said first duct into said second ducted area, for drawing in water to minimize cavitation along said second ducted area.

* * * * *